US009033619B2

(12) United States Patent
Riggle, Jr.

(10) Patent No.: US 9,033,619 B2
(45) Date of Patent: May 19, 2015

(54) TRENCH SHORING APPARATUSES

(71) Applicant: John Riggle, Jr., Clackamas, OR (US)

(72) Inventor: John Riggle, Jr., Clackamas, OR (US)

( * ) Notice: Subject to any disclaimer, the term of this patent is extended or adjusted under 35 U.S.C. 154(b) by 0 days.

(21) Appl. No.: 14/108,145

(22) Filed: Dec. 16, 2013

(65) Prior Publication Data

US 2014/0169889 A1 Jun. 19, 2014

Related U.S. Application Data

(60) Provisional application No. 61/737,654, filed on Dec. 14, 2012.

(51) Int. Cl.
*E02D 17/08* (2006.01)
*E02D 17/00* (2006.01)

(52) U.S. Cl.
CPC ..... *E02D 17/08* (2013.01); *E02D 17/00* (2013.01); *E02D 17/086* (2013.01)

(58) Field of Classification Search
CPC ..... E02D 17/086; E02D 17/08; E02D 17/083; E02D 17/00; E02D 17/04; E01C 2301/18
USPC ..... 405/272, 282, 283
See application file for complete search history.

(56) References Cited

U.S. PATENT DOCUMENTS

| | | | | | |
|---|---|---|---|---|---|
| 2,922,283 | A | * | 1/1960 | Porter | 405/283 |
| 3,204,415 | A | * | 9/1965 | Hill, Jr. et al. | 405/283 |
| 3,335,573 | A | | 8/1967 | Ward | |
| 3,404,533 | A | * | 10/1968 | Brunton | 405/282 |
| 3,966,220 | A | | 6/1976 | Forsyth et al. | |
| 4,002,035 | A | | 1/1977 | Wright | |
| 4,310,267 | A | * | 1/1982 | Davis | 405/283 |
| 4,370,079 | A | * | 1/1983 | Pizzirani | 405/272 |
| 4,741,646 | A | * | 5/1988 | Hatch | 405/175 |
| 4,787,781 | A | * | 11/1988 | Bradberry | 405/282 |
| 4,789,266 | A | | 12/1988 | Clarke, Jr. et al. | |
| 4,874,271 | A | | 10/1989 | Arnold | |
| 5,183,360 | A | * | 2/1993 | Freeman | 411/400 |
| 5,306,103 | A | | 4/1994 | Spencer | |
| 5,336,023 | A | | 8/1994 | Burdine | |

(Continued)

FOREIGN PATENT DOCUMENTS

| | | |
|---|---|---|
| JP | 06-336723 | 12/1994 |
| JP | 08-109634 | 4/1996 |

*Primary Examiner* — John Kreck
*Assistant Examiner* — Carib Oquendo
(74) *Attorney, Agent, or Firm* — Mohr Intellectual Property Law Solutions, PC

(57) ABSTRACT

Trench shoring apparatuses configured to be moved by construction equipment and including major vertical arms, struts attached to the lower ends of the major vertical arms, connectors rigidly connected to the major vertical arms proximate the upper ends of the major vertical arms, the connectors being configured to detachably couple with the construction equipment. In some examples, struts include strut arms movably supported by the major vertical arm and strut actuators configured to selectively extend and retract the strut arm laterally across trenches, the strut arms being configured to pair with shoring plates proximate outer ends. In some examples, connectors include first retaining arms and second retaining arms extending transverse to the major vertical arm. In some examples, connectors include metallic rings defining openings sized to receive projections of construction equipment. Some examples include remote control receivers and remote control transmitters in electronic communication with the remote control receivers.

20 Claims, 9 Drawing Sheets

(56) References Cited

U.S. PATENT DOCUMENTS

| | | | | |
|---|---|---|---|---|
| 5,368,121 | A | 11/1994 | Priefert | |
| 5,647,688 | A | 7/1997 | Guntert et al. | |
| 5,865,567 | A | 2/1999 | Wilkinson | |
| 5,931,608 | A | 8/1999 | Wilkinson | |
| 6,017,170 | A | 1/2000 | Michalo | |
| 6,164,875 | A | 12/2000 | Wu et al. | |
| 6,224,296 | B1 * | 5/2001 | Fukumori | 405/282 |
| 6,394,405 | B1 * | 5/2002 | Roxton et al. | 248/354.1 |
| 7,258,511 | B1 * | 8/2007 | Cerda | 405/282 |
| 7,276,822 | B2 | 10/2007 | Chen | |
| 2004/0247398 | A1 | 12/2004 | Lane et al. | |
| 2008/0050213 | A1 * | 2/2008 | Kundel | 414/572 |
| 2008/0247831 | A1 * | 10/2008 | Worley | 405/283 |
| 2011/0305528 | A1 | 12/2011 | Riggle, Jr. | |
| 2011/0305529 | A1 | 12/2011 | Riggle, Jr. | |

* cited by examiner

TRENCH SHORING APPARATUSES

CROSS REFERENCE TO RELATED APPLICATIONS

This application claims priority to U.S. Application Ser. No. 61/737,654, filed on Dec. 14, 2012, which is hereby incorporated by reference for all purposes.

BACKGROUND

The present disclosure relates generally to trench shoring apparatuses. In particular, trench shoring apparatuses being configured to mechanically expand and retract shoring panels, adaptable for attachment to a wide variety of presently-existing construction operating equipment via connectors, and/or controlled remotely via remote control transmitters and receivers are described.

Existing trench shoring apparatuses and methods are often slow and may create life threatening safety hazards. Specifically, conventional trench shoring apparatuses are often very difficult to move and to install along the length of a trench. Additionally, conventional trench shoring apparatuses and methods often require the user to enter the trench during shoring, which may be potentially life threatening if the trench walls cave in during shoring.

Because of these safety hazards, many conventional trench shoring devices and methods are often quite dangerous. Accordingly, there exists a need for improvements that improve trench shoring apparatuses' safety profiles. In particular, improvements that reduce the need for users to enter un-shored or improperly shored trenches are greatly needed. Accordingly, there exists a need devices that allow trench shoring struts and shoring plates to be inserted into trenches and extended to a proper shoring position without requiring a user to manually enter the trench and adjust the strut and shoring plates.

Further, many conventional trench shoring apparatuses are expensive, single-purpose devices suitable only for shoring trenches. Accordingly, trench shoring activities can add a great deal of financial expense to a project.

Moreover, conventional trench shoring apparatuses are not configured to readily interface and be used cooperatively with construction equipment commonly on site where trenches are being dug. The ability to easily and effectively use common construction equipment to move trench shoring apparatuses into and out of trenches would make shoring trenches faster and less expensive. Accordingly, there exists a need for trench shoring apparatuses that can readily interface with common construction equipment to cooperatively perform trench shoring activities.

Thus, there exists a need for trench shoring apparatuses that improve upon and advance the design of known trench shoring apparatuses and methods. Examples of new and useful trench shoring apparatuses relevant to the needs existing in the field are discussed below.

Disclosure addressing one or more of the identified existing needs is provided in the detailed description below. U.S. application Ser. No. 13/107,851, filed on May 13, 2011, U.S. application Ser. No. 13/013,636, filed on Jan. 25, 2011, and PCT Application Serial No. PCT/US12/37123, filed on May 9, 2012, each provide examples of trench shoring apparatuses and additional or alternative features relevant to the disclosure provided below. The complete disclosure of U.S. application Ser. No. 13/107,851, U.S. application Ser. No. 13/013,636, and PCT Application Serial No. PCT/US12/37123, are herein incorporated by reference for all purposes.

SUMMARY

The present disclosure is directed to trench shoring apparatuses configured to be moved by construction equipment. The trench shoring apparatuses include a major vertical arm, struts attached to the lower ends of the major vertical arm, a connector rigidly connected to the major vertical arm proximate the upper end of the major vertical arm. The connector is configured to detachably couple with the construction equipment.

In some examples, the struts include strut arms movably supported by the major vertical arm and strut actuators configured to selectively extend and retract the strut arm laterally across trenches. Further, the strut arms may be configured to pair with shoring plates proximate outer ends. In some examples, the connector includes first retaining arms and second retaining arms extending transverse to the major vertical arm.

In other examples, the connector includes metallic rings defining openings sized to receive projections of construction equipment. Some trench shoring apparatus examples include remote control receivers and remote control transmitters in electronic communication with the remote control receivers.

BRIEF DESCRIPTION OF THE DRAWINGS

FIG. 10 is a close up view of a remote control depicted in FIG. 1.

FIG. 12 is a close up view of a remote control depicted in FIG. 4.

FIG. 13 is a close up view of a remote control depicted in FIG. 5.

FIG. 15 is a close up view of a remote control depicted in FIG. 8.

DETAILED DESCRIPTION

The disclosed apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various apparatuses are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
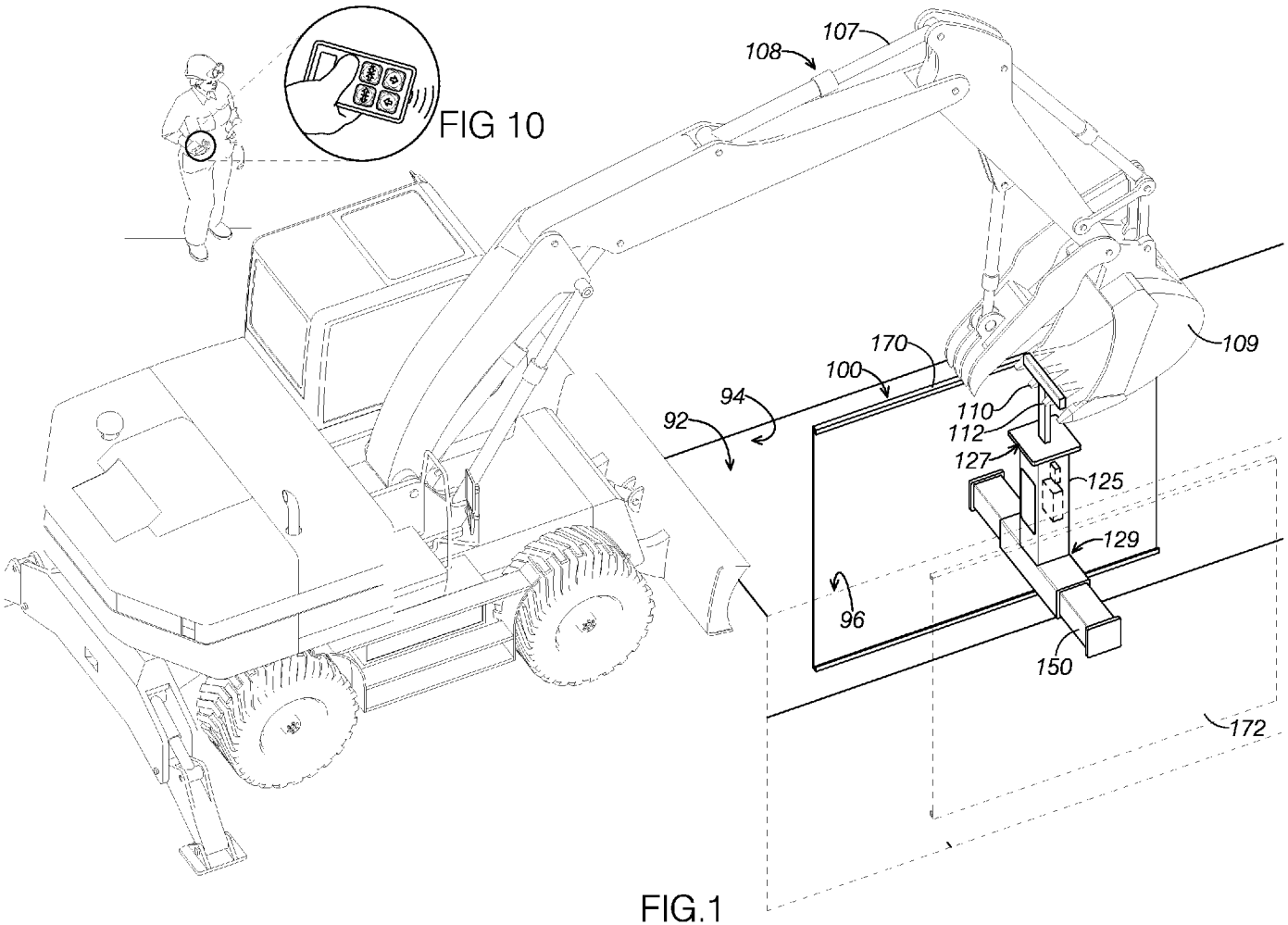
FIG. 1 is a perspective view of a first example of a trench shoring apparatus coupled with a piece of construction operating equipment defining a backhoe.
Figure 2:
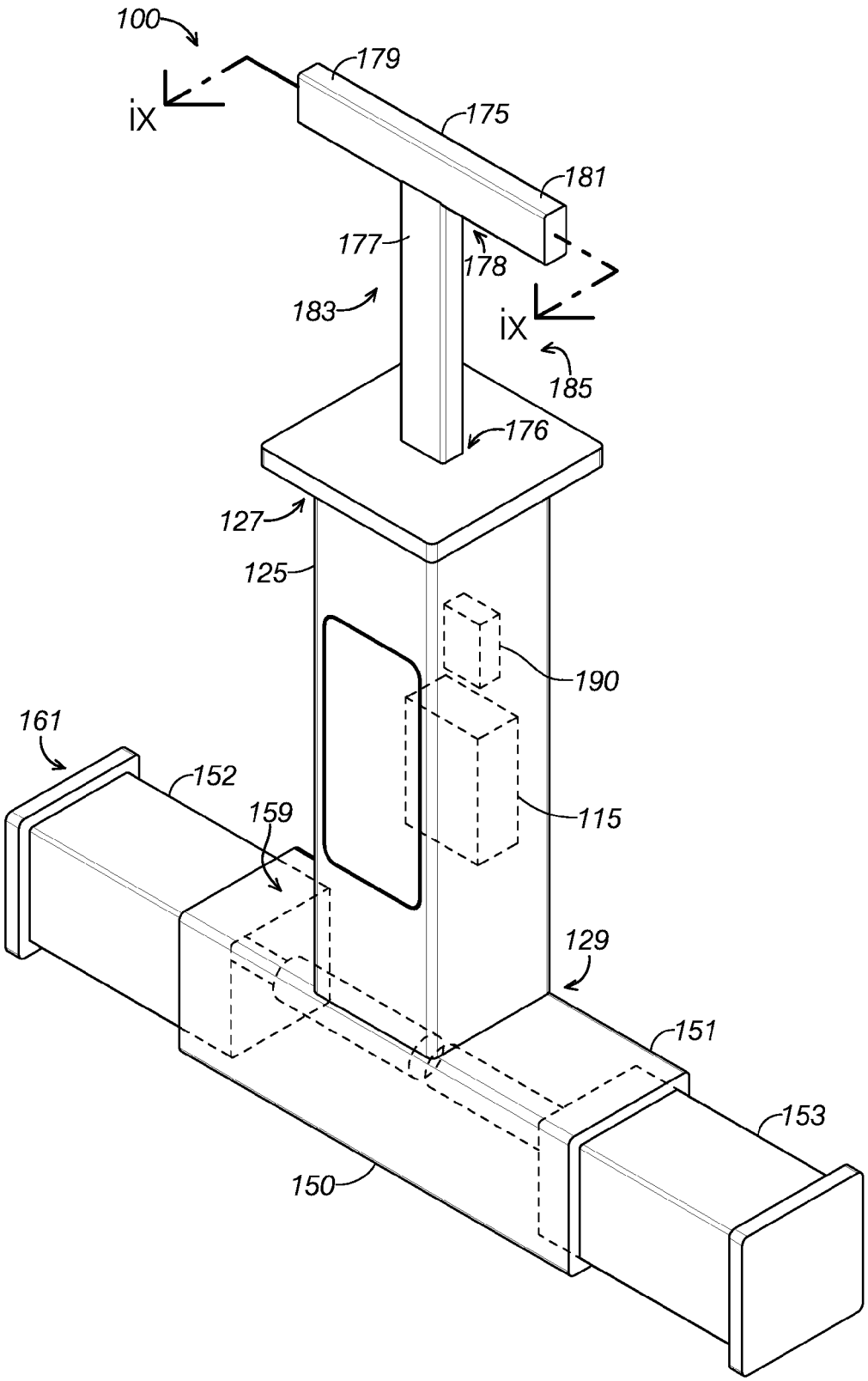
FIG. 2 is a perspective view of the trench shoring apparatus shown in FIG. 1 with shoring plates removed and with internal elements illustrated in dash-dash-dash broken lines.

With reference to FIGS. 1-4, an example of a trench shoring apparatus relevant to the needs discussed above, trench shoring apparatus 100, will now be described. As FIG. 2 shows, apparatus 100 includes a major vertical arm 125, a strut 150, a connector 175, an internal power supply 115, and a remote control receiver 190. As FIG. 1 shows, apparatus 100 further includes a first shoring plate 170 and a second shoring plate 172.

Apparatus 100 is configured to shore longitudinally extending trenches, such as trench 92 defined by first lateral trench wall 94 and second lateral trench wall 96. In particular, apparatus 100 includes numerous features that adapt it to be placed in a trench, adjusted between expanded and retracted configurations within the trench, and removed from the trench without a user needing to manually enter the trench. Because improperly-shored trenches are a safety hazard, any improvement that allows trenches to be shored without a user entering the trench dramatically improves the safety of trench-shoring projects.

As FIG. 1 further illustrates, apparatus 100 is configured to be selectively and removably supported by construction equipment without the use of complicated attaching means. Indeed, as FIG. 1 illustrates, connector 175 is adapted to interface with construction equipment. In particular, connector 175 may interface with construction equipment having two or more horizontally spaced, load-bearing projections, such as construction equipment 108.

Construction equipment 108 defines a backhoe and includes an articulating arm 107 and a bucket 109. As FIG. 1 shows, bucket 109 defines a first projection and a second projection: the first projection defines a first tooth 110 of the backhoe while the second projection defines a second tooth 112 of the backhoe. By coupling connector 175 with bucket 109, construction equipment 108 may support apparatus 100 as articulating arm 107 is used to adjust the position of apparatus 100.

Apparatus 100 may effectively interface with construction equipment in addition to backhoes. For example, apparatus 100 is configured to interface with forklifts or other construction operating equipment including two load-bearing projections with which connector 175 can couple.

Figures 3, 11:
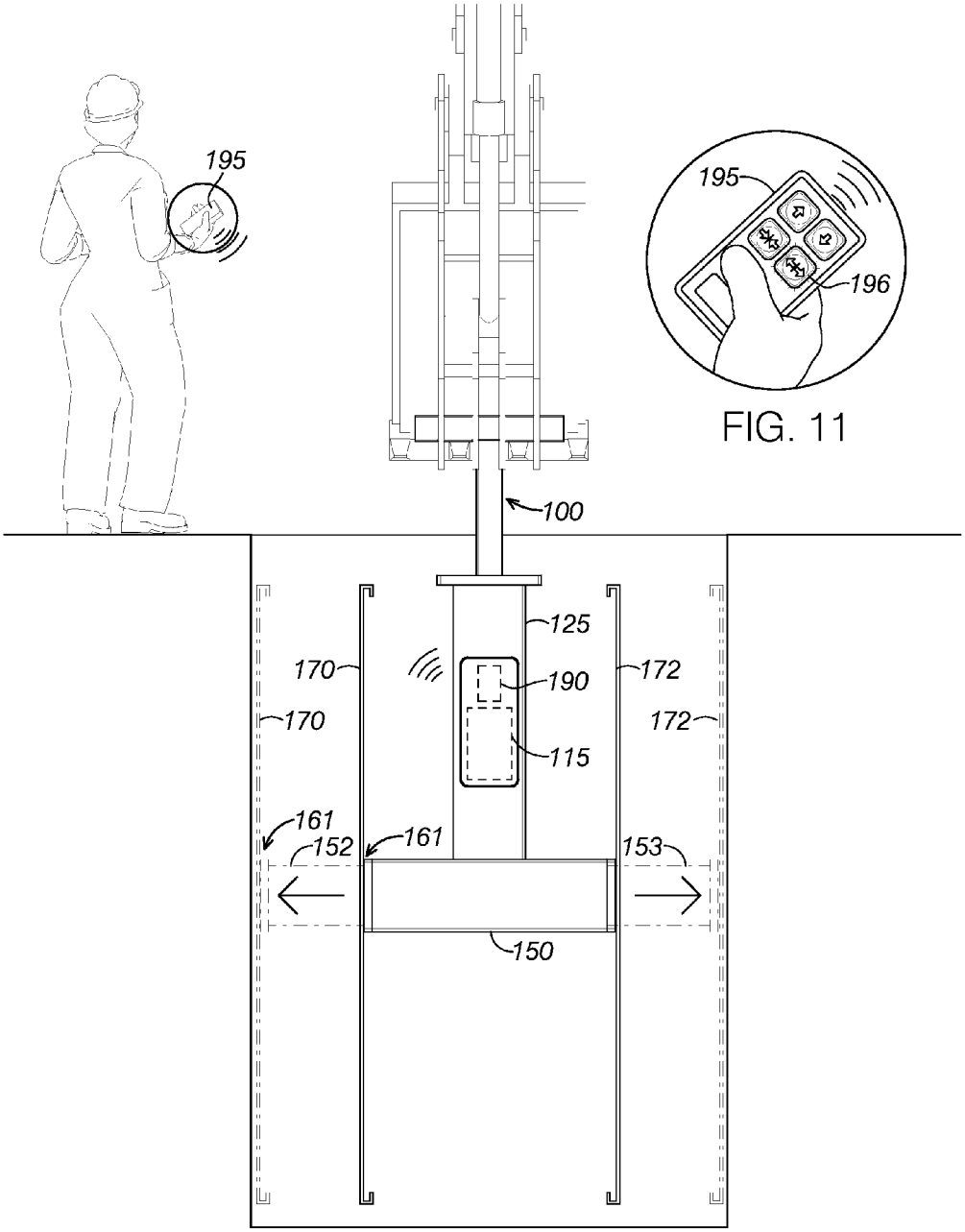
FIG. 3 is a side elevation view of the trench shoring apparatus shown in FIG. 1 showing the trench shoring apparatus in a retracted configuration in solid lines and showing the trench shoring apparatus in an extended configuration in dash-dot-dash broken lines.
FIG. 11 is a close up view of a remote control depicted in FIG. 3.
Figure 4:
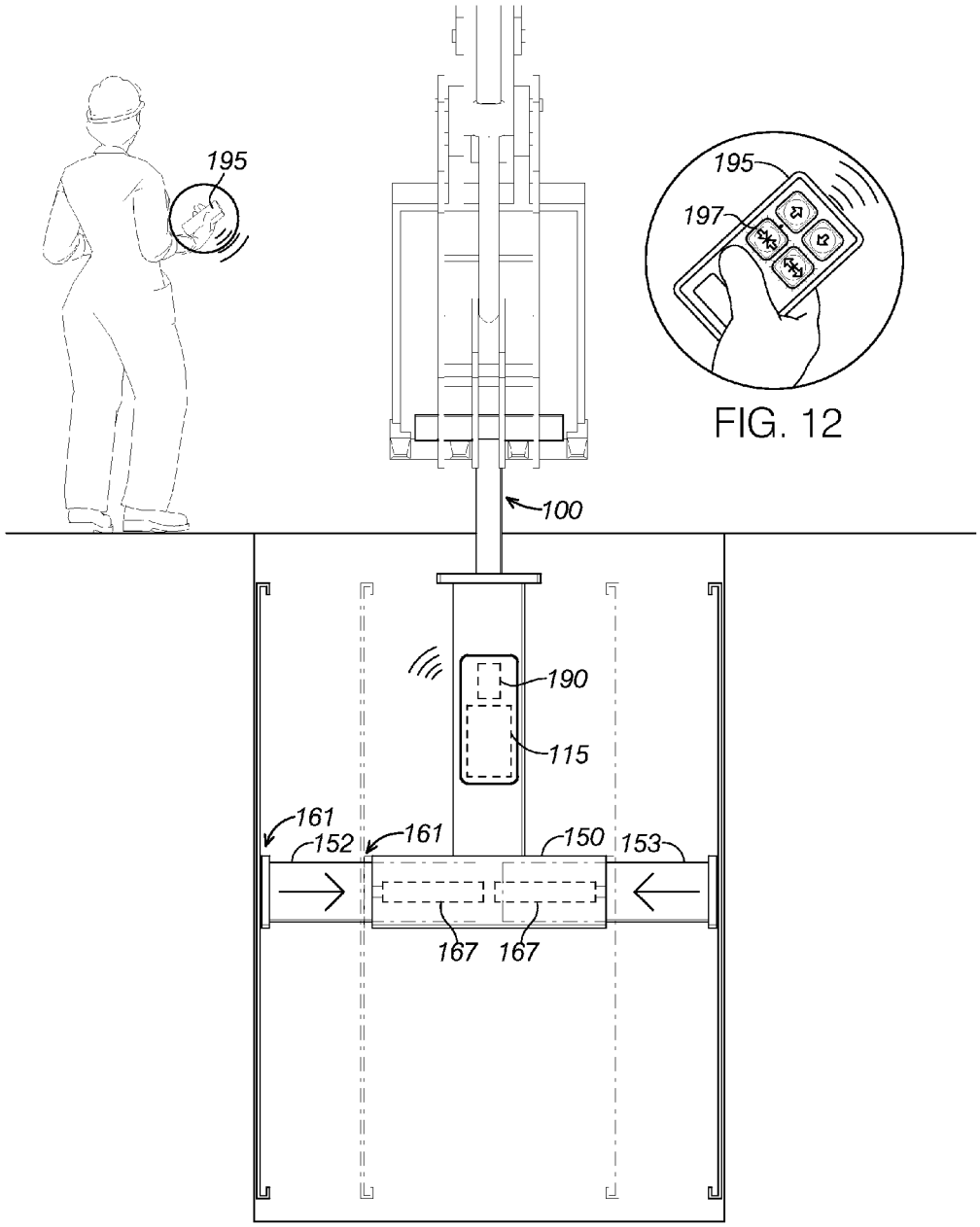
FIG. 4 is a side elevation view of the trench shoring apparatus shown in FIG. 1 showing the trench shoring apparatus in an extended configuration in solid lines and showing the trench shoring apparatus in a retracted configuration dash-dot-dash broken lines.

As FIGS. 3 and 4 illustrate, apparatus 100 enables users to control the extending and retracting functions of the strut arms of apparatus 100 using a remote control transmitter 195. Remote control transmitter 195 is configured to communicate with remote control receiver 190 via a wireless data connection. By allowing users to control the extending and retracting functions of the strut arms, the remote control mechanism of apparatus 100 allows users to adjust shoring plates to a proper shoring position within a trench without physically entering the trench. When apparatus 100 is to be removed from the trench, the remote control mechanism further allows users to adjust the shoring plates to a proper removal/insertion position.

As FIG. 2 shows, major vertical arm 125 extends from an arm upper end 127 proximate construction equipment 108 to an arm lower end 129 distal from arm upper end 127 and proximate strut 150. As FIG. 1 shows, major vertical arm 125 defines a length selected to position strut 150 at an appropriate shoring position within a trench of a predetermined depth.

As FIG. 1 shows, the distance at which major vertical arm 125 extends may be selected to space the construction equipment from strut 150 and, as a result, the shoring plates. As FIGS. 3 and 4 show, strut 150 is substantially aligned with the center of first shoring plate 170 and second shoring plate 172. As FIGS. 3 and 4 also show, major vertical arm 125 extends at approximately one half the height of the shoring plates. Accordingly, all of first shoring plate 170 and second shoring plate 172 are positioned below construction equipment 108 (and in this example, below bucket 109), thereby allowing first shoring plate 170 and second shoring plate 172 to adjust between extended and retracted positions without inadvertently contacting construction equipment 108.

As FIG. 2 shows, strut 150 is connected to major vertical arm 125 proximate arm lower end 129. As further shown in FIG. 2, strut 150 includes a strut housing 151, a first strut arm 152, a second strut arm 153, and a strut actuator 167. As FIGS. 1, 3, and 4 each illustrate, strut 150 is configured to support first shoring plate 170 and second shoring plate 172. Strut 150 is also configured to mechanically extend and retract the shoring plates between extended and retracted positions. FIG. 3, for example, shows strut 150 extending first strut arm 152 and second strut arm 153 to position first shoring plate 170 and second shoring plate 172 in an extended, shoring configuration.

As FIG. 2 illustrates, strut housing 151 houses strut actuator 167 and interior portions of first strut arm 152 and second strut arm 153. In some examples, strut housing additionally or alternatively house electrical or mechanical lines that connect strut actuator 167, first strut arm 152, and second strut arm 153 to elements with which they are in electrical or mechanical communication, such as internal power supply 115 and/or remote control receiver 190.

As FIG. 2 shows, first strut arm 152 is movably supported by strut 150 at a predetermined vertical position selected to allow apparatus 100 to properly shore a trench. As FIG. 2 illustrates, strut 150 is vertically supported by major vertical arm 125 proximate arm lower end 129 of major vertical arm 125. Accordingly, first strut arm 152 is likewise vertically supported by major vertical arm 125 proximate arm lower end 129.

As FIG. 2 shows, first strut arm 152 extends from an inner end 159 received within strut housing 151 to an outer end 161 positioned proximate a first lateral trench wall of a shored trench. As FIG. 1 shows, first strut arm 152 is configured to pair with a shoring plate proximate outer end 161. For example, first strut arm 152 is affixed to first shoring plate 170 at outer end 161, but this particular location and type of pairing is not specifically required.

As FIG. 2 illustrates, second strut arm 153 is substantially similar to first strut arm 152, but extends in an opposite direction and is similarly received within strut housing 151 on the side opposite first strut arm 152. As FIG. 1 shows, second strut arm 153 extends from strut housing 151 towards a second lateral trench wall of a shored trench opposite the first lateral trench wall proximate first strut arm 152.

Figure 9:
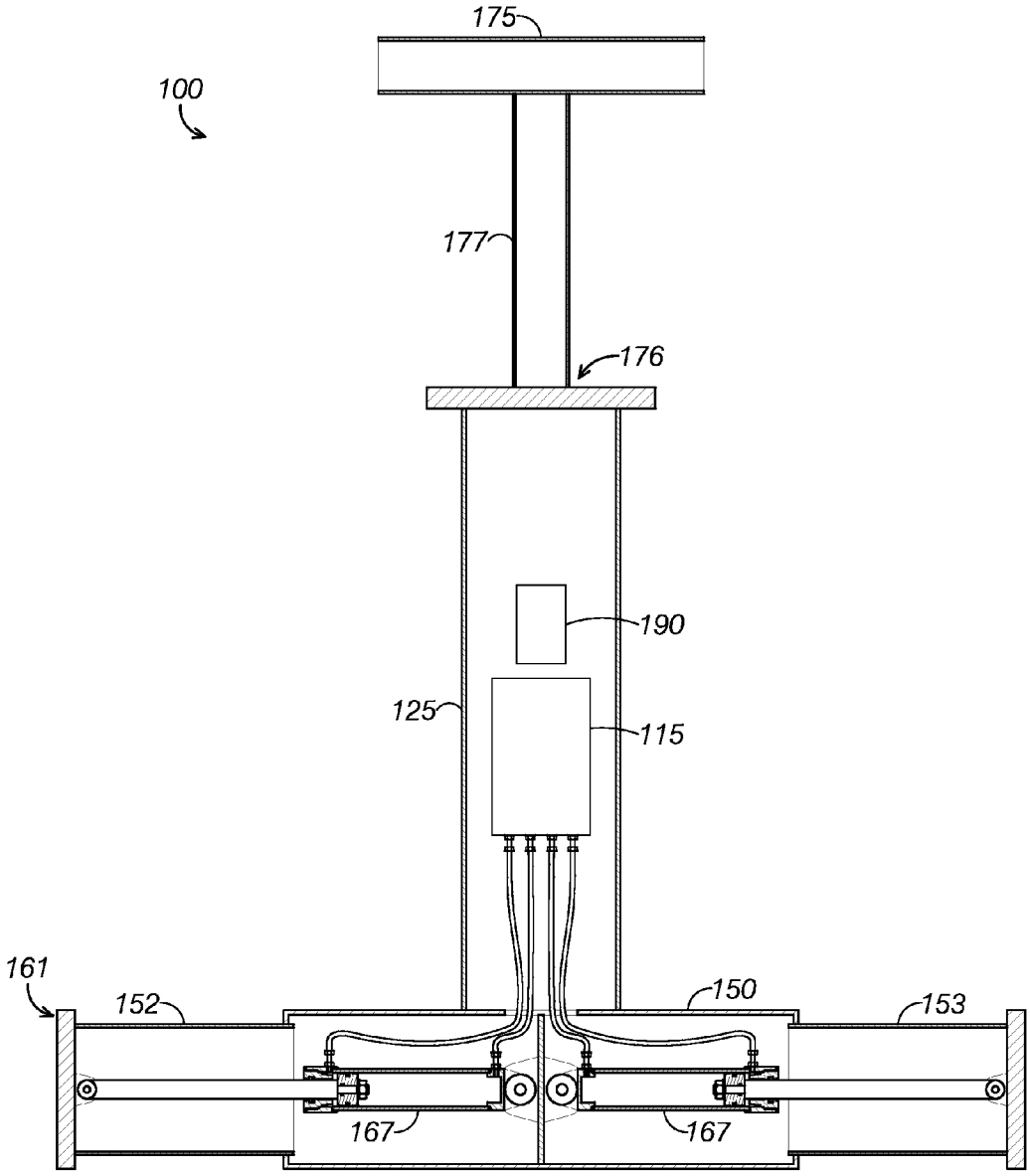
FIG. 9 is a cross-sectional view of the trench shoring apparatus shown in FIG. 2 taken about the line 9-9 to show the internal elements of the trench shoring apparatus.

As FIGS. 2 and 9 show, strut actuator 167 is disposed within strut housing 151 between first strut arm 152 and second strut arm 153. With reference to FIG. 9, strut actuator 167 defines a pair of hydraulic cylinders, with a first cylinder 166 engaged with and attached to inner end 159 of first strut arm 152 and a second cylinder 168 similarly engaged with and attached to an interior end of second strut arm 153.

Each cylinder is configured to mechanically drive the associated strut arm to extend the associated strut arm towards the corresponding trench wall. For example, the first cylinder is configured to drive first strut arm 152 out of strut housing 151 and toward first lateral trench wall 94.

Conversely, each cylinder is configured to mechanically pull the associated strut arm to retract the associated strut arm away from the corresponding trench wall. For example, the first cylinder is configured to pull first strut arm 152 toward strut housing 151 and away from first lateral trench wall 94.

Accordingly, strut actuator 167 is configured to selectively extend and retract both strut arms laterally across a longitudinally-extending trench. Indeed, strut actuator 167 is configured to adjust the width of strut 150 to properly shore trenches of a wide variety of widths.

Although the strut actuator of the illustrated example includes hydraulic actuators, this is not specifically required. Some examples may, for example, include electric actuators, pneumatic actuators, or other known linear actuating devices.

As FIG. 1 shows, first shoring plate 170 is paired to outer end 161 of first strut arm 152. First shoring plate 170 may be substantially similar to several known shoring plates, such as those previously discussed in U.S. Patent Application Publication 2011/0305529. Second shoring plate 172 is likewise substantially similar to previously discussed shoring plates and is paired to the outer end of second strut arm 153.

As FIG. 2 illustrates, connector 175 is rigidly connected to arm upper end 127 of major vertical arm 125. As FIG. 2 shows, connector 175 includes a vertical projection 177, a first retaining arm 179, and a second retaining arm 181. As FIG. 2 illustrates, connector 175 further defines a first void 183 and a second void 185. With reference to FIG. 1, connector 175 allows apparatus 100 to detachably couple with construction equipment, such as construction equipment 108.

For example, connector 175 is configured to couple with construction equipment 108, as shown in FIG. 1, by receiving vertical projection 177 between first tooth 110 and second tooth 112 of bucket 109. When so inserted, first retaining arm 179 and second retaining arm 181 will remain engaged with the top of first tooth 110 and second tooth 112, respectively, when apparatus 100 is suspended and construction equipment 108 is supporting apparatus 100. Accordingly, when articulating arm 107 is used to raise bucket 109 and when bucket 109 is paired with connector 175, articulating arm 107 may be used to raise apparatus 100 and adjust its position to insert or remove it from a trench.

Similarly, articulating arm 107 may lower bucket 109 to release apparatus 100 from bucket 109. When released, first retaining arm 179 and second retaining arm 181 disengage with the teeth of bucket 109, allowing articulating arm 107 to maneuver bucket 109 away from apparatus 100.

Articulating arm 107, bucket 109, and the teeth of bucket 109 are each understood to be suitable for use in heavy construction operations. Accordingly, they are sufficiently rigid and structurally sound to lift, support, and maneuver apparatus 100. Construction equipment similar to construction equipment 108 is commonly used on construction sites for non-trench-shoring uses, and thus may already be present on sites where trench shoring is required. Because connector 175 allows apparatus 100 to be easily paired with construction equipment 108, apparatus 100 is able to provide remotely controlled trench shoring operations to construction projects without requiring extensive additional heavy operating equipment.

Although connector 175 is connected on arm upper end 127, this is not specifically required. Connectors may additionally or alternatively be connected proximate arm upper end 127, such as by extending from one or more lateral sides of major vertical arm 125

As FIG. 2 illustrates, vertical projection 177 is fixed to the upper end of major vertical arm 125. As FIG. 1 illustrates, vertical projection 177 defines a width selected to be received between two adjacent projections of a piece of construction equipment, such as first tooth 110 and second tooth 112. Accordingly, vertical projection 177 may be easily received between the two adjacent projections.

Further, vertical projection 177 extends from a first end 176 affixed to major vertical arm 125 to a second end 178 spaced from major vertical arm 125. The length at which vertical projection 177 extends from major vertical arm 125 is selected to position first retaining arm 179 and second retaining arm 181 at a selected height.

As FIG. 2 shows, first retaining arm 179 extends from major vertical arm 125 at a vertical position selected to define first void 183 between first retaining arm 179 and major vertical arm 125. As FIG. 2 also shows, second retaining arm 181 additionally extends from vertical projection 177 substantially aligned with and opposite to first retaining arm 179. Indeed, first retaining arm 179 is integral with second retaining arm 181 to define a single retaining arm. Further, first retaining arm 179 and second retaining arm 181 are integral with vertical projection 177 such that connector 175 defines a single, unified, integral body.

Both first retaining arm 179 and second retaining arm 181 extend horizontally from vertical projection 177 at a distance selected to engage with two selected projections of a piece of construction equipment. For example, both first retaining arm 179 and second retaining arm 181 extend at lengths greater than one half of the distance of the spacing between first tooth 110 and second tooth 112. Because both retaining arms extend at greater than half of the spacing between first tooth 110 and second tooth 112, a portion of first retaining arm 179 and second retaining arm 181 is configured to align with a portion of first tooth 110 and second tooth 112, respectively, when the rigid vertical projection is received between the first projection and the second projection.

As FIG. 1 shows, first void 183 is large enough to receive a retaining projection connected to construction equipment, such as first tooth 110.

As FIG. 2 illustrates, second retaining arm 181 defines second void 185 between second retaining arm 181 and major vertical arm 125. Like first void 183, second void 185 is large enough to receive a retaining projection connected to construction equipment, such as second tooth 112.

As FIG. 2 illustrates, internal power supply 115 is disposed within major vertical arm 125. Internal power supply 115 defines an electric battery with electrical storage capacity sufficient to power strut actuator 167 through at least one extension/retraction cycle. An extension/retraction cycle, in some examples, includes extending first strut arm 152 and second strut arm 153 from a fully retracted configuration to a fully extended configuration and returning first strut arm 152 and second strut arm 153 from the fully extended configuration back to the fully retracted configuration.

Internal power supply 115 is in electric communication with strut actuator 167 and is configured to deliver energy thereto. Strut actuator 167 is configured to drive or pull first strut arm 152 and second strut arm 153 with energy received from internal power supply 115 to mechanically adjust the position of the outer end of the strut arm relative the trench wall. Accordingly, internal power supply 115 is configured to provide the power required to adjust first shoring plate 170 and second shoring plate 172 to a proper shoring position within a trench.

Because internal power supply 115 is housed within apparatus 100, a user does not need to manually attach a power supply to apparatus 100 to provide the energy necessary for it extending and retracting functions. Because there is no requirement for a user to attach a power source to apparatus 100 (or otherwise deliver power to apparatus 100), internal power supply 115 further reduces the need of a user to enter an improperly shored trench. Further, because apparatus 100 does not require attachment of an external hydraulic line or other power source, apparatus 100 is compatible with a wide variety of types of construction operating equipment.

In some examples, internal power supply 115 may be placed in electric communication with paired construction equipment, such as by connecting internal power supply 115 to an electrical outlet of the equipment with a wire. In such examples, internal power supply 115 may be configured to receive and store such energy delivered from the construction equipment.

As FIG. 2 shows, remote control receiver 190 is housed within major vertical arm 125. As FIG. 1 shows, remote control receiver 190 is in data communication with remote control transmitter 195. As FIGS. 3 and 4 illustrate, remote control transmitter 195 is configured to communicate a transmitter signal to remote control receiver 190 in response to a user manipulating remote control transmitter 195.

In response to receiving the transmitter signal, remote control receiver 190 sends an actuator signal to strut actuator 167 that causes strut actuator 167 to draw energy from internal power supply 115 and mechanically adjust, by hydraulically adjusting its cylinders, the position of the outer end 161 of first strut arm 152 relative a trench wall, such as first lateral trench wall 94. In some examples, the actuator signal defines encoded data translated by the strut actuator to follow the signal's instructions. In other examples, the signal may simply define electrical energy delivered to the strut actuator that causes the strut actuator become operational.

In some examples, remote control transmitter 195 may communicate transmitter signals to remote control receiver 190 wirelessly in response to user manipulation of remote control transmitter 195. Indeed, as FIGS. 3 and 4 illustrate, remote control transmitter 195 includes a plurality of buttons, each configured to wirelessly communicate a unique signal to remote control receiver 190. The wireless communication may occur by any known wireless communication protocol, such as common WiFi and Bluetooth protocols. Additionally or alternatively, the wireless communication may occur via infrared communication or other known analog communication means.

For example, FIG. 3 illustrates a user having selected extension button 196. Upon the user selecting extension button 196, remote control transmitter 195 sends a transmitter signal indicating that remote control receiver 190 should extend first strut arm 152 and second strut arm 153. Accordingly, remote control receiver 190 sends an actuator signal to strut actuator 167 directing it to extend first strut arm 152 and second strut arm 153. As FIG. 4 shows, strut actuator 167 mechanically extends first strut arm 152 and second strut arm 153 in response.

Similarly, FIG. 4 illustrates a user having selected retraction button 197. Upon the user selecting retraction button 197, remote control transmitter 195 sends a transmitter signal indicating that remote control receiver 190 should retract first strut arm 152 and second strut arm 153. Accordingly, remote control receiver 190 sends an actuator signal to strut actuator 167 directing it to retract first strut arm 152 and second strut arm 153. As FIG. 4 shows, strut actuator 167 mechanically retracts first strut arm 152 and second strut arm 153 in response.

Remote control receiver 190 is powered by internal power supply 115. Accordingly, remote control receiver 190 does not require attachment of an external power supply to apparatus 100 to operate.

Turning to FIGS. 5-8, a second example of a trench shoring apparatus, apparatus 200 will now be described. Apparatus 200 includes many similar or identical features to trench shoring apparatus 100 combined in unique and distinct ways. Thus, for the sake of brevity, each feature of apparatus 200 will not be redundantly explained. Rather, key distinctions between trench shoring apparatus 200 and apparatus 100 will be described in detail and the reader should reference the discussion above for features substantially similar between the two trench shoring apparatuses.

Figure 5:
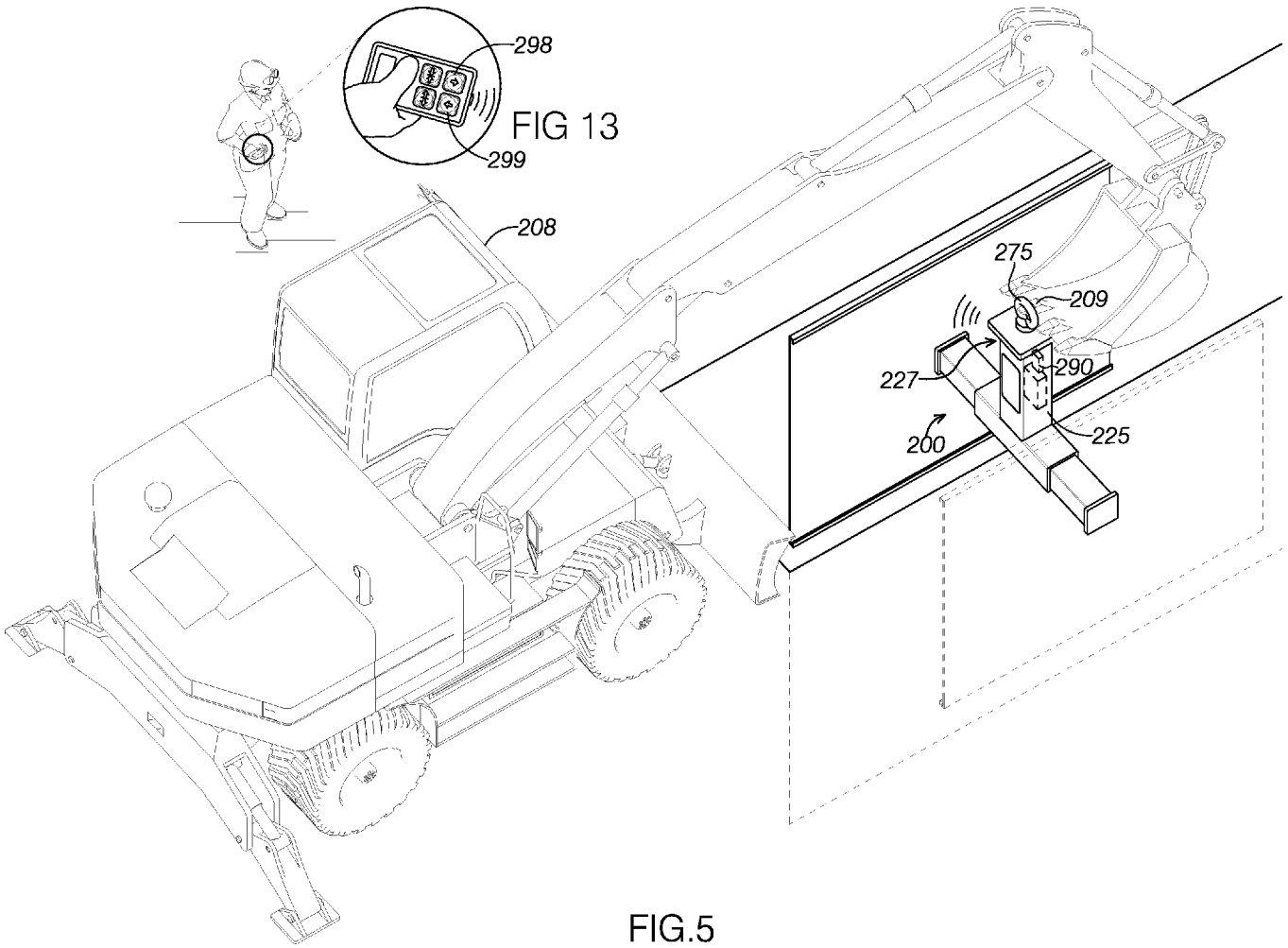
FIG. 5 is a perspective view of a second example of a trench shoring apparatus coupled with a piece of construction operating equipment defining a backhoe.
Figure 6A:
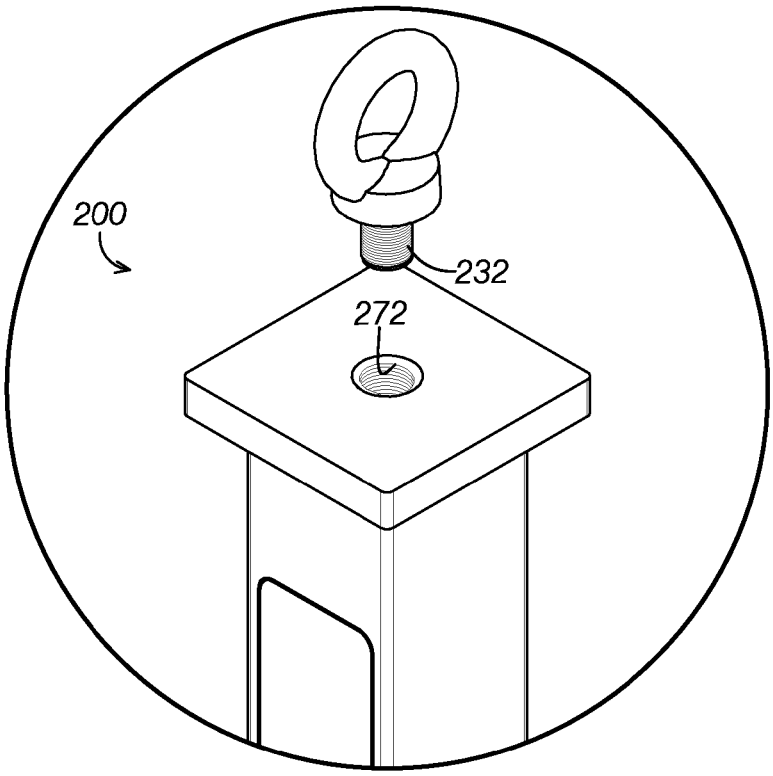
FIG. 6A illustrates a connector and a major vertical arm of the trench shoring apparatus shown in FIG. 5 in a disconnected configuration.
Figure 6B:
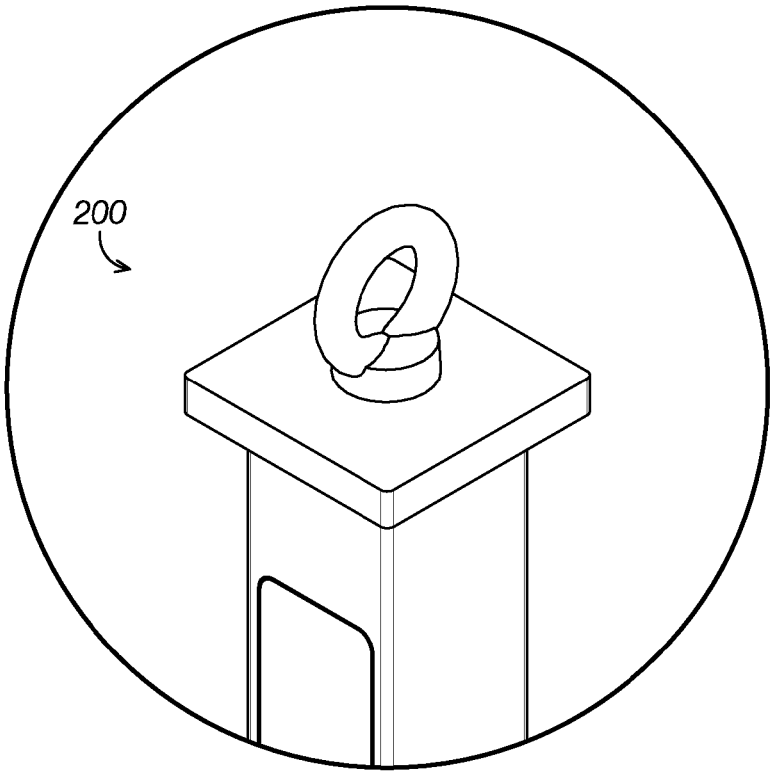
FIG. 6B illustrates a connector of the trench shoring apparatus and a major vertical arm of the trench shoring apparatus in a disconnected configuration.

As FIGS. 5 and 6A-6B show, apparatus 200 includes a connector 275 that differs from connector 175 of apparatus 100. As FIGS. 6A-6B show, connector 275 includes a metallic ring 277 defining an opening 279. Opening 279 is configured to receive a projection extending from apparatus 200 to be supported by apparatus 200. Because opening 279 is substantially aligned with the horizontal center of apparatus 200, connector 275 allows apparatus 200 to be supported by a single projection extending from a piece of construction equipment.

Figure 8:
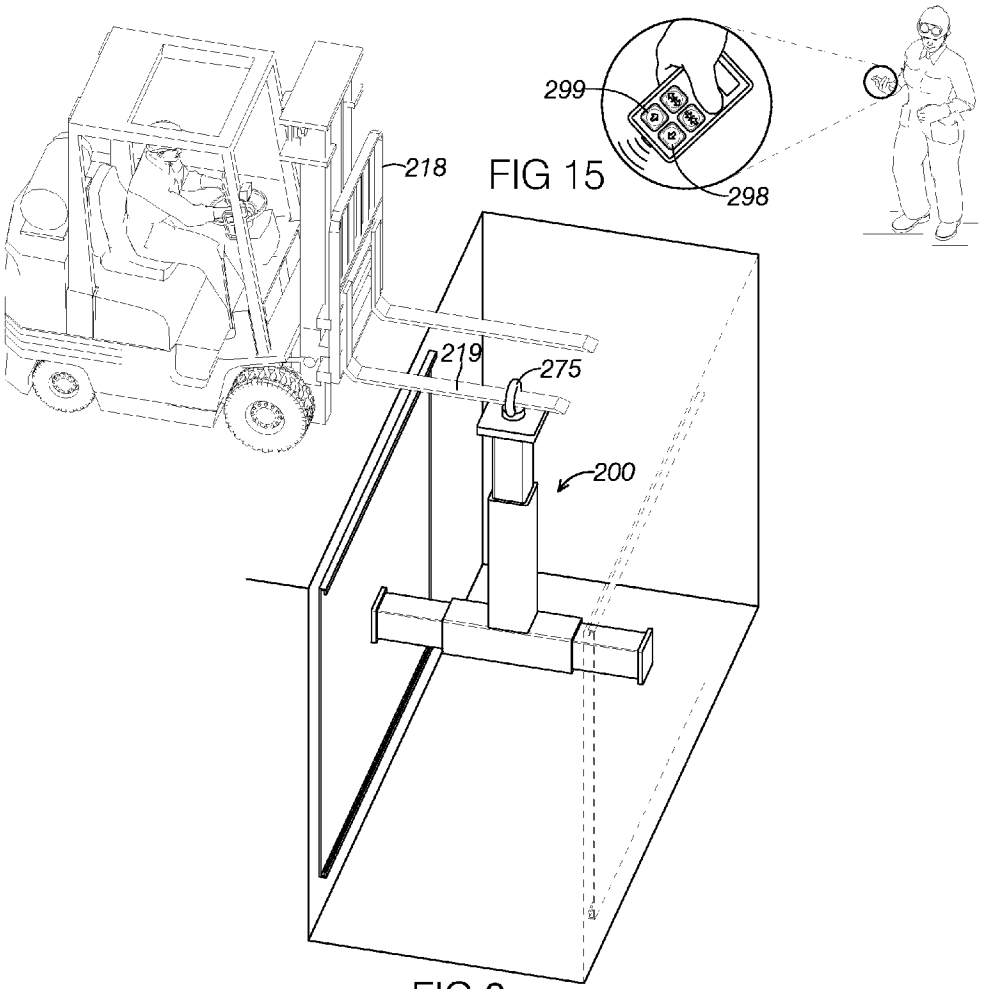
FIG. 8 is a perspective view of the trench shoring apparatus shown in FIG. 5 coupled with a piece of construction operating equipment defining a forklift.

FIG. 5, for example, shows apparatus 200 coupled to a single tooth 209 of backhoe 208 by inserting tooth 209 into opening 279. Similarly, FIG. 8 shows apparatus 200 coupled to a single fork 219 of forklift 218 by inserting fork 219 into opening 279.

Figures 7, 14:
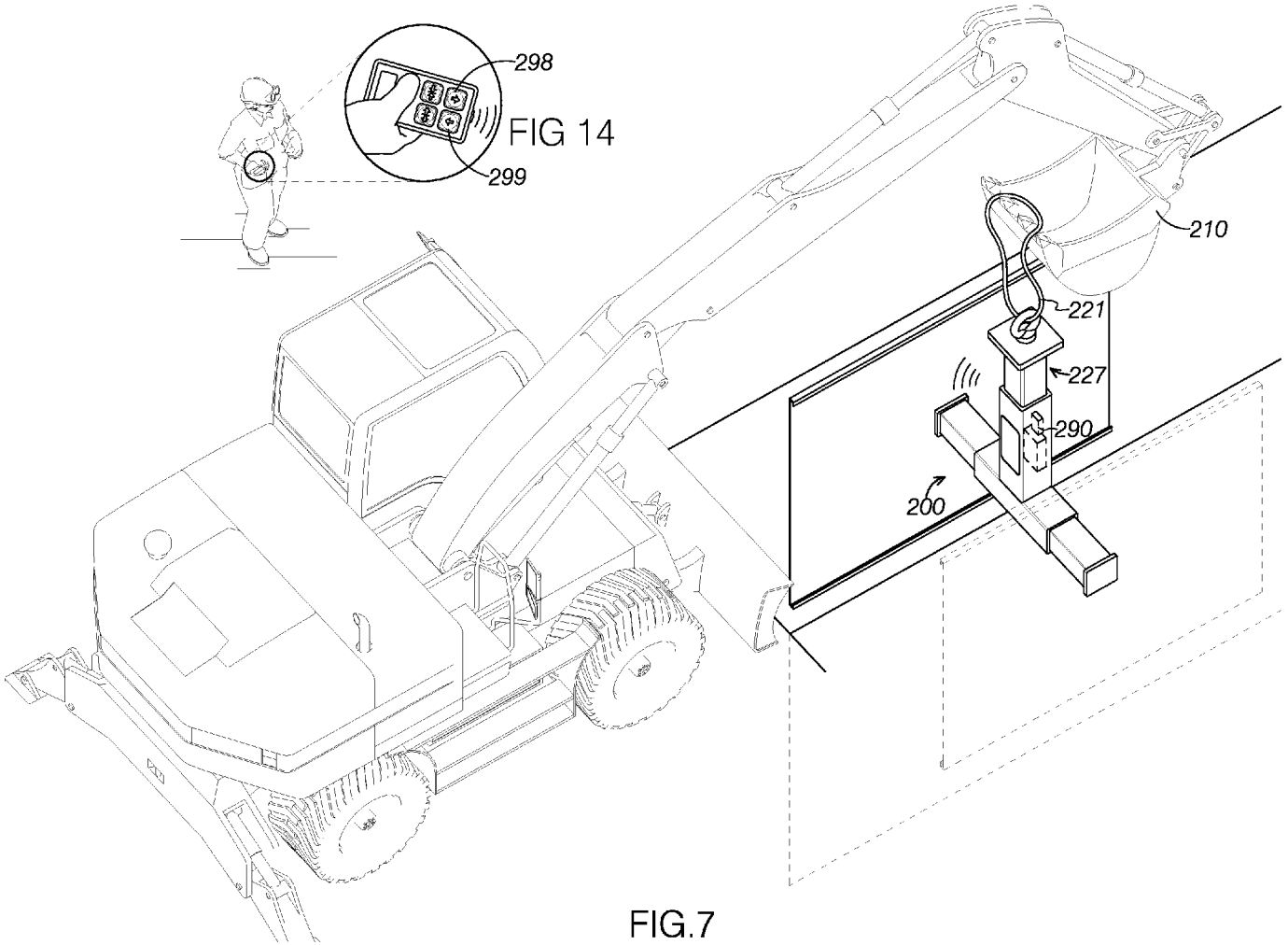
FIG. 7 the trench shoring apparatus shown in FIG. 5 coupled with the backhoe via a metal cable.
FIG. 14 is a close up view of a remote control depicted in FIG. 7.

Connector 275 is additionally configured for attaching to construction equipment by using suspension means, such as ropes, cables, chains, and straps, that can be inserted through opening 279. FIG. 7, for example, shows apparatus 200 suspended by a circular cable 221 that is supported on a top end by a bucket 210 of backhoe 208 and routed through opening 279 on a lower end. As FIG. 7 shows, cable 221 has a gauge sufficient to suspend the apparatus when the metal cable is routed through the opening and supported by the projection.

As FIGS. 5 and 6A-6B show, apparatus 200 includes a telescoping major vertical arm 225 that is similar to major vertical arm 125, but includes a number of additional or alternative features. As FIGS. 5 and 7 collectively show, telescoping major vertical arm 225 is configured to telescope proximate an upper end 227. By telescoping, apparatus 200 may be adjusted to space the strut at a variety of vertical positions relative the construction equipment.

Because apparatus 200 includes a variable-length major vertical arm, apparatus 200 may be adaptable to a wide variety of trenches defining different depths. FIG. 5, for example, shows telescoping major vertical arm 225 in a retracted configuration, whereas FIGS. 7 and 8 show telescoping major vertical arm 225 in an extended configuration.

Further, telescoping major vertical arm 225 includes an extendable interior arm member 268 and a vertically-oriented arm actuator 226. As FIGS. 7 and 8 show, interior arm member 268 is configured to be at least partially positioned within the interior of telescoping major vertical arm 225. Arm actuator 226 defines a hydraulic cylinder, substantially similar to cylinder 166 and cylinder 168 and is engaged with the bottom of interior arm member 268. Like cylinder 166 and cylinder 168, arm actuator 226 is in electrical communication with an interior power source within apparatus 200 and is configured to extend and/or retract in response to signals received from remote control receiver 290. Arm actuator 226 is configured to adjust telescoping major vertical arm 225 between extended configurations and retracted configurations by adjusting the position of the bottom of interior arm member 268.

As FIGS. 5, 7, and 8 show, apparatus 200 additionally includes a remote control receiver 290 operatively paired with a remote control transmitter 295, substantially similar to remote control receiver 190 and remote control transmitter 195. As FIGS. 5, 7, and 8 show, remote control transmitter 295 includes an up button 298 and a down button 299.

Similar to the remote control features of apparatus 100, remote control transmitter 295, sends a transmitter signal in response to a user selecting up button 298 to instruct remote control receiver 290 to retract interior arm member 268, which positions apparatus 200 at a higher vertical position. In response, remote control receiver 290 sends an actuator signal to arm actuator 226, directing it to retract interior arm member 268. Arm actuator 226 mechanically extends interior arm member 268 in response. Interior arm member 268 may be extended in a similar manner in response to a user selecting down button 299.

As FIGS. 6A and 6B show, interior arm member 268 defines a threaded opening 272 on its top end proximate its horizontal center. As FIGS. 6A and 6B show, connector 275 additionally includes a threaded fastener 232 configured to be threaded into threaded opening 272. By allowing connector 275 to be threadingly attached and detached from apparatus 200, apparatus 200 may be adapted to a variety of construction equipment with interchangeable connectors. An additional or alternative connector may include, for example, a t-bar shaped connector substantially similar to connector 175, but including a threaded fastener substantially similar to threaded fastener 232 disposed on the bottom of its vertical projection.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A trench shoring apparatus configured to be moved by construction equipment having a first projection and a second projection spaced from the first projection, the trench shoring apparatus being used to shore longitudinally extending trenches formed in a region of ground and defining a lateral trench wall, the trench shoring apparatus comprising:

a major vertical arm extending from an upper end to a lower end distal the upper end;

a strut attached to the lower end of the major vertical arm, the strut including:

a strut arm movably supported by the major vertical arm proximate the lower end of the major vertical arm, the strut arm extending to an outer end proximate the lateral trench wall and being configured to pair with a shoring plate proximate the outer end; and a strut actuator configured to selectively extend and retract the strut arm laterally across the longitudinally extending trench; and a connector rigidly connected to the major vertical arm proximate the upper end of the major vertical arm, the connector being configured to detachably couple with the construction equipment and including:

a first retaining arm extending transverse the major vertical arm and positioned to define a first void, the first void being disposed below the first retaining arm and sized to receive the first projection; and a second retaining arm extending transverse to the major vertical arm, the second retaining arm being aligned with the first retaining arm and positioned to define a second void, the second void being disposed below the second retaining arm and sized to receive the second projection;

a remote control receiver; and a remote transmitter in electronic communication with the remote control receiver;

wherein:

the connector consists of:

a rigid vertical projection fixed to the upper end of the major vertical arm, the vertical projection:

defining a width selected to be received between the first projection and the second projection; and extending from a first end proximate the major vertical arm and a second end above the major vertical arm;

the first retaining arm; and the second retaining arm;

the first retaining arm extends from the rigid vertical projection proximate the second end of the rigid vertical projection, the first retaining arm extending greater than one half of the spacing between the first projection and the second projection to align a portion of the first retaining arm when the rigid vertical projection is received between the first projection and the second projection; and the second retaining arm extends from the rigid vertical projection proximate the second end of the rigid vertical projection, the second retaining arm extending greater than one half of the spacing between the first projection and the second projection and in an opposing direction relative the first retaining arm to align a portion of the second retaining arm when the rigid vertical projection is received between the first projection and the second projection; and the remote control receiver communicates, in response to user manipulation of the remote transmitter, a signal that causes the strut actuator to mechanically adjust the position of the outer end of the strut arm relative the trench wall.

2. The apparatus of claim 1, wherein:

the first retaining arm extends horizontally from the rigid vertical projection; and the second retaining arm extends horizontally from the rigid vertical projection in an opposite direction as the first retaining arm.

3. The apparatus of claim 1, wherein the first retaining arm is integral with the second retaining arm to define a single retaining arm.

4. The apparatus of claim 1, further comprising an internal power supply in electric communication with the strut actuator, the capacity of the internal power supply being sufficient to power the strut actuator to extend and retract the strut arm.

5. The apparatus of claim 4, wherein the remote control receiver communicates, in response to user manipulation of the remote transmitter, a signal that causes the strut actuator to draw energy from the internal power supply.

6. The apparatus of claim 4, wherein the internal power supply is disposed inside the major vertical arm.

7. The apparatus of claim 4, wherein the internal power supply is:

in electric communication with the construction equipment; and configured to store electrical energy received from the construction equipment.

8. The apparatus of claim 1, wherein the remote transmitter is configured to transmit data to the remote control receiver wirelessly.

9. The apparatus of claim 1, wherein:

the signal defines a first signal;

the major vertical arm is configured to telescope and includes an arm actuator configured to adjust the major vertical arm between an expanded configuration and a retracted configuration; and the remote control receiver communicates, in response to user manipulation of the remote transmitter, a second signal that causes the arm actuator to adjust the length of the major vertical arm.

10. A trench shoring apparatus configured to detachably couple to a piece of construction equipment, the trench shoring apparatus being used to shore longitudinally extending trenches formed in a region of ground and defining a lateral trench wall, the trench shoring apparatus comprising:

a major vertical arm extending from an upper end to a lower end distal the upper end;

a strut attached to the lower end of the major vertical arm, the strut including:

a strut arm movably supported by the major vertical arm proximate the lower end of the major vertical arm, the strut arm extending to an outer end proximate the lateral trench wall and being configured to pair with a shoring plate proximate the outer end; and a strut actuator configured to selectively extend and retract the strut arm laterally across the longitudinally extending trench;

a connector rigidly connected to the major vertical arm proximate the upper end of the major vertical arm, the connector configured to detachably couple with a piece of construction equipment;

a remote control receiver; and a remote transmitter in electronic communication with the remote control receiver;

wherein the remote control receiver communicates, in response to user manipulation of the remote transmitter, a signal that causes the strut actuator to mechanically adjust the position of the outer end of the strut arm relative the trench wall in response to user manipulation of the remote transmitter.

11. The apparatus of claim 10, further comprising an internal power supply in electric communication with the strut actuator, the internal power supply:

being disposed within an interior of the major vertical arm; and defining a capacity sufficient to extend and retract the strut arm wherein the remote control receiver communicates, in response to user manipulation of the remote transmitter, the signal that causes the strut actuator to:

draw energy from the internal power supply; and cause the strut actuator to user the energy drawn from the internal power supply to mechanically adjust the position of the outer end of the strut arm relative the trench wall in response to user manipulation of the remote transmitter.

12. The apparatus of claim 10, wherein:

the signal defines a first signal;

the major vertical arm includes an arm actuator configured to adjust the major vertical arm between an expanded configuration and a retracted configuration; and the remote control receiver communicates, in response to user manipulation of the remote transmitter, a second signal that causes the arm actuator to adjust the length of the major vertical arm in response to user manipulation of the remote transmitter.

13. A trench shoring apparatus configured to be moved by construction equipment having a first projection and a second projection spaced from the first projection, the trench shoring apparatus being used to shore longitudinally extending trenches formed in a region of ground and defining a lateral trench wall, the trench shoring apparatus comprising:

a major vertical arm extending from an upper end to a lower end distal the upper end;

a strut attached to the lower end of the major vertical arm, the strut including:

a strut arm movably supported by the major vertical arm proximate the lower end of the major vertical arm, the strut arm extending to an outer end proximate the lateral trench wall and being configured to pair with a shoring plate proximate the outer end; and a strut actuator configured to selectively extend and retract the strut arm laterally across the longitudinally extending trench; and a connector rigidly connected to the major vertical arm proximate the upper end of the major vertical arm, the connector being configured to detachably couple with the construction equipment and including:

a first retaining arm extending transverse the major vertical arm and positioned to define a first void, the first void being disposed below the first retaining arm and sized to receive the first projection; and a second retaining arm extending transverse to the major vertical arm, the second retaining arm being aligned with the first retaining arm and positioned to define a second void, the second void being disposed below the second retaining arm and sized to receive the second projection; and an internal power supply in electric communication with the strut actuator, the capacity of the internal power supply being sufficient to power the strut actuator to extend and retract the strut arm;

wherein:

the connector consists of:

a rigid vertical projection fixed to the upper end of the major vertical arm, the vertical projection:

defining a width selected to be received between the first projection and the second projection; and extending from a first end proximate the major vertical arm and a second end above the major vertical arm;

the first retaining arm; and the second retaining arm;

the first retaining arm extends from the rigid vertical projection proximate the second end of the rigid vertical projection, the first retaining arm extending greater than one half of the spacing between the first projection and the second projection to align a portion of the first retaining arm when the rigid vertical projection is received between the first projection and the second projection; and the second retaining arm extends from the rigid vertical projection proximate the second end of the rigid vertical projection, the second retaining arm extending greater than one half of the spacing between the first projection and the second projection and in an opposing direction relative the first retaining arm to align a portion of the second retaining arm when the rigid vertical projection is received between the first projection and the second projection.

14. The apparatus of claim 13, further comprising:

a remote control receiver; and a remote transmitter in electronic communication with the remote control receiver;

wherein the remote control receiver communicates, in response to user manipulation of the remote transmitter, a signal that causes the strut actuator to:

draw energy from the internal power supply; and mechanically adjust the position of the outer end of the strut arm relative the trench wall.

15. The apparatus of claim 13, wherein the internal power supply is disposed inside the major vertical arm.

16. The apparatus of claim 13, wherein the internal power supply is:

in electric communication with the construction equipment; and configured to store electrical energy received from the construction equipment.

17. The apparatus of claim 13, wherein the strut actuator is configured to draw energy from the internal power supply to hydraulically actuate the strut arm.

18. The apparatus of claim 13, wherein the projection defines a fork and the construction equipment defines a forklift.

19. The apparatus of claim 13, wherein:

the construction equipment includes an articulating arm and a bucket supported on the articulating arm; and the first projection and the second projection extend from the bucket and define teeth of the bucket.

20. The apparatus of claim 13, wherein:

the major vertical arm defines a threaded opening proximate the upper end of the major vertical arm; and the connector includes a threaded fastener configured to threadingly couple with the threaded opening defined by the major vertical arm.

* * * * *